US005655206A

United States Patent [19]

Miyazawa

[11] Patent Number: 5,655,206

[45] Date of Patent: Aug. 5, 1997

[54] SHEET FEEDER OF AN IMAGE FORMING APPARATUS

[75] Inventor: Takuji Miyazawa, Ebina, Japan

[73] Assignee: Fuji Xerox Co., Ltd., Tokyo, Japan

[21] Appl. No.: 573,521

[22] Filed: Dec. 15, 1995

[30] Foreign Application Priority Data

Dec. 19, 1994 [JP] Japan ..... 6-334383

[51] Int. Cl.[6] ..... G03G 15/00

[52] U.S. Cl. ..... 399/361; 399/107; 384/295; 384/439

[58] Field of Search ..... 355/308, 309; 384/419, 428, 439, 295

[56] References Cited

U.S. PATENT DOCUMENTS

| | | | |
|---|---|---|---|
| 3,815,380 | 6/1974 | Esmay | 355/309 X |
| 4,113,374 | 9/1978 | Nakamura et al. | 355/308 |
| 4,116,556 | 9/1978 | Tanaka et al. | 355/309 X |

FOREIGN PATENT DOCUMENTS

| | | |
|---|---|---|
| 58-125538 | 7/1983 | Japan . |
| 59-186841 | 10/1984 | Japan . |
| 2-231324 | 9/1990 | Japan . |
| 5-4733 | 1/1993 | Japan . |

*Primary Examiner*—Matthew S. Smith
*Attorney, Agent, or Firm*—Oliff & Berridge

[57] ABSTRACT

In a sheet feeding roller unit in which the pickup roller and the sheet feeding roller are integrated into one body, bearing members are respectively arranged at both ends of the sheet feeding roller shaft of the sheet feeding roller. The first bearing member is inserted into the first bearing engaging member arranged in the sheet feeding unit, and the third bearing member is arranged so that it can be moved by the lever member in the axial direction, and the third bearing member is attached to the second bearing engaging member when it is moved in the axial direction. Under the condition that it is pushed by the spring, the sheet feeding roller can be fixed and held with respect to the sheet feeding unit.

10 Claims, 9 Drawing Sheets

SHEET FEEDER OF AN IMAGE FORMING APPARATUS

BACKGROUND OF THE INVENTION

The present invention is related to a sheet feeder of an image forming apparatus having a roller attaching and detaching mechanism by which a roller can be easily replaced, and further the rotation of a shaft on which the roller is mounted is seldom obstructed by the mechanism.

In an image forming apparatus such as an electrophotographic copier and a laser beam printer, there are provided a plurality of sheet feeding trays in the sheet feeding section, and sheets of paper of different sizes are accommodated on the sheet feeding trays, so that sheets of paper of various sizes can be fed and images of various enlargement and reduction ratios can be formed on sheets of paper. Corresponding to the sheet feeding trays arranged in the sheet feeding section of the image forming apparatus, there is provided a sheet feeder in the sheet feeding section of the image forming apparatus. In accordance with an output of information about the selection of sheets of paper outputted by a control unit of the image forming apparatus, a sheet feeder corresponding to the command is operated, and sheets of paper are fed while they are handled one by one.

For example, a conventional sheet feeder arranged in the sheet feed section of the image forming apparatus is disclosed in Japanese Unexamined Patent Publication No. Hei. 2- 231,324. The above conventional example is shown in FIG. 14. As shown in the drawing, there is provided a sheet feeding unit 10 in the sheet feeding section of the image forming apparatus, which composes a means for feeding sheets of paper from a sheet feeding tray 1. In the example shown in FIG. 14, there is provided a bottom plate 2 for supporting sheets of paper on the sheet feed tray 1, and also there is provided a restriction guide 3 at a rear end of the tray with respect to the sheet feeding direction. In order to attach the sheet feeding tray 1 to the sheet feeing section and also to detach the sheet feeding tray 1 from the sheet feeing section, there are provided guide rails 4, 4*a* so that the sheet feeding tray can be easily moved. The bottom plate 2 arranged on the sheet feeding side of sheets of paper is moved upward and downward by a lifting arm 5. The bottom plate 2 is oscillated to a position at which the sheet of paper P comes into contact with a pickup roller 85, which is arranged in the sheet feeding unit, with a predetermined pressure, so that the sheet feeding motion can be easily conducted.

The sheet feeding unit includes: a pickup roller 85 to pick up sheets of paper accommodated in the sheet feeding tray; a sheet feeding roller 61 which composes a sheet handling device; a retard roller 30; and á conveyance roller device 17 arranged at a position which corresponds to an end of the sheet feeding path 16. An end of the sheet feeding unit composes a portion of the sheet conveyance path 15 arranged upward and downward along the side of the sheet feeding section. The end of the sheet feeding unit conveys a sheet of paper upward which is sent from the sheet feeding unit arranged in the lower portion. A roller unit arranged in the above sheet feeding unit is composed as shown in FIG. 15. The retard roller 30 composing a sheet handling device is supported at a position under the sheet feeding roller 61 by a bracket 31 capable of oscillating around a support shaft 32. The retard roller 30 is pushed toward the sheet feeding roller by the action of an elastic member 33. There is provided a torque limiter 34 in the drive system to drive the retard roller 30. In order to drive the retard roller 30 in the same direction as the rotational direction of the sheet feeding roller 61, there is provided a drive unit 23, so that a handling action can be conducted on a sheet of paper between the sheet feeding roller 61 and the retard roller 30.

The sheet feeding roller 61 arranged above the retard roller 30 is combined with the pickup roller 85, so that a sheet feeding roller unit 50 can be composed. The sheet feeding roller 61 and the pickup roller 85 are supported by one support bracket 51. The pickup roller 85 is arranged in such a manner that the pickup roller 85 can be oscillated around a sheet feeding roller shaft 60 of the sheet feeding roller 61. When the pickup roller 85 is lowered, it comes into contact with an upper surface of the uppermost sheet of paper accommodated on the sheet feeding tray. An arm 55*a* is protruded from the side of a support bracket 51 of the sheet feeding roller unit. The arm 55*a* is engaged with an arm 37 of a link 36 oscillated by a solenoid 35, so that the sheet feeding roller unit 50 can be moved upward and downward by the action of the solenoid 35. Due to this operation, sheets of paper can be fed from the sheet feeding tray. In addition to the above arrangement, the following arrangement is provided. Under the condition that the pickup roller is lowered and set at a position on the sheet of paper P accommodated on the sheet feeding tray, a piece of information about the height of the stack of sheets of paper is obtained by a detection means of the sheet height sensor 57. According to the thus obtained information, the bottom plate lifting mechanism shown in FIG. 14 is operated, so that the position at which the upper surface of sheets of paper comes into contact with the pickup roller can be regulated.

In the sheet feeder composed in the manner described above, roller members such as a sheet feeding roller and a retard roller are made of rubber. Accordingly, the roller members tend to be stained and worn out by abrasion. As a result, the sheet feeding characteristics of the rollers are deteriorated, and sheets of paper can not be fed smoothly. In this case, it is necessary to replace the defective rollers. In order to solve the above problems, in the conventional sheet feeder, the roller and support shaft are integrated into one body, and in the case of abrasion of the roller, both the roller and the support shaft are replaced all together. In the case of the sheet feeding unit shown in FIG. 15, the sheet feeding roller unit can be integrally replaced with respect to the sheet feeding unit.

In this case, the following problems may be encountered. When the sheet feeding roller unit is integrally replaced with respect to the sheet feeding unit, it is complicated to attach the roller shafts to the frame of the sheet feeder, and it is also complicated to detach the roller shafts from the frame of the sheet feeder. For example, when the shafts are attached to or detached from the frame of the sheet feeder, it is necessary to attach and detach a number of small fixing members such as E-rings, screws and others, and it is very complicated to control such small parts. Accordingly, even when repair parts are distributed to a user so that they can be replaced by the user in the process of maintenance, the user can not maintain the apparatus by himself. Therefore, a skilled service man must visit the user and replace the sheet feeding roller unit.

SUMMARY OF THE INVENTION

The present invention has been accomplished to solve the above problems caused when the conventional roller are replaced in the process of maintenance.

It is an object of the present invention to provide an apparatus in which the sheet feeding roller unit can be easily attached to and detached from the frame of the sheet feeder without using special tools, so that common users can easily replace a defective sheet feeding roller unit with a new one.

It is another object of the present invention to provide a sheet feeder of an image forming apparatus having a roller attaching and detaching mechanism by which a roller can be easily replaced, and further the rotation of a shaft on which the roller is mounted is seldom obstructed by the mechanism.

According to the aspect 1 of the present invention is a sheet feeder of an image forming apparatus comprising: a bracket having a first and a second bearing means; a first shaft member supported by the first and second bearing means; a first roller member arranged between the first and second bearing means, attached to the first shaft member; a third bearing means arranged at one end of the first shaft member, capable of being moved in the axial direction; a pushing means for pushing the third bearing member in the axial direction of the shaft so that the third bearing means can be separate from the bracket; a lever member for moving the third bearing member, resisting a pushing force of the pushing means, the lever member being capable of moving in the axial direction; a first bearing engaging means for detachably engaging with the first bearing means; and a second bearing engaging means for detachably engaging with the third bearing means in the axial direction by the movement of the lever member and the push of the pushing member.

Further, according to the aspect 2 of the present invention is a sheet feeder of an image forming apparatus comprising: a roller member; a shaft member of the roller member; a supporting means for rotatably supporting the shaft member; a bearing for supporting the shaft member, capable of moving in the axial direction of the shaft member; a pushing means for pushing the bearing in the axial direction of the shaft member; and a first engaging means for engaging with the bearing by a pushing force given by the pushing means, the first engaging means being arranged on a casing of the apparatus, wherein the pushing means applies no force to the shaft member in the axial direction when the pushing force is received by the supporting means and the bearing.

Still further, according to the aspect 3 of the present invention is a sheet feeder of an image forming apparatus comprising: a roller member; a shaft member of the roller member; a supporting member for rotatably supporting the shaft member; a pushing means for pushing the supporting member in the axial direction of the shaft member; and an engaging means for engaging with the supporting means by a pushing force given by the pushing means, the engaging means being arranged on a casing of the apparatus.

In the above sheet feeder of the present invention, there is provided a sheet feeding roller unit with respect to a sheet feeding unit arranged corresponding to the sheet feeding section to which sheets of paper are fed from the sheet feeding tray, and the sheet feeding roller unit is composed of a sheet feeding roller and a pickup roller supported by a shaft of the sheet feeding roller in such a manner that the pickup roller can be oscillated around the shaft. In a portion where the shaft of the sheet feeding roller is connected with a drive unit of the sheet feeding unit, the sheet feeding roller unit is attached to and detached from the sheet feeding unit. The first bearing member arranged at one end of the shaft is engaged with and supported by the first bearing engaging member, and the second bearing member arranged at the other end of the shaft is detachably attached to the second bearing engaging member. Further, a lever member is arranged to the second bearing member which can be attached to and detached from the second bearing engaging member. When the lever member is moved by an operator's hand, the second bearing member can be attached to and detached from the second bearing engaging member, so that the sheet feeding roller unit can be replaced without using tools. Consequently, it is possible for a user to replace the rollers of the sheet feeder of the present invention without asking a skilled service man for maintenance. Therefore, only when a spare sheet feeding roller unit is distributed to a user, it is possible for the user to easily maintain the image forming apparatus. Accordingly, availability of the image forming apparatus can be enhanced.

DETAILED DESCRIPTION OF THE PREFERRED EMBODIMENTS

Figure 1:
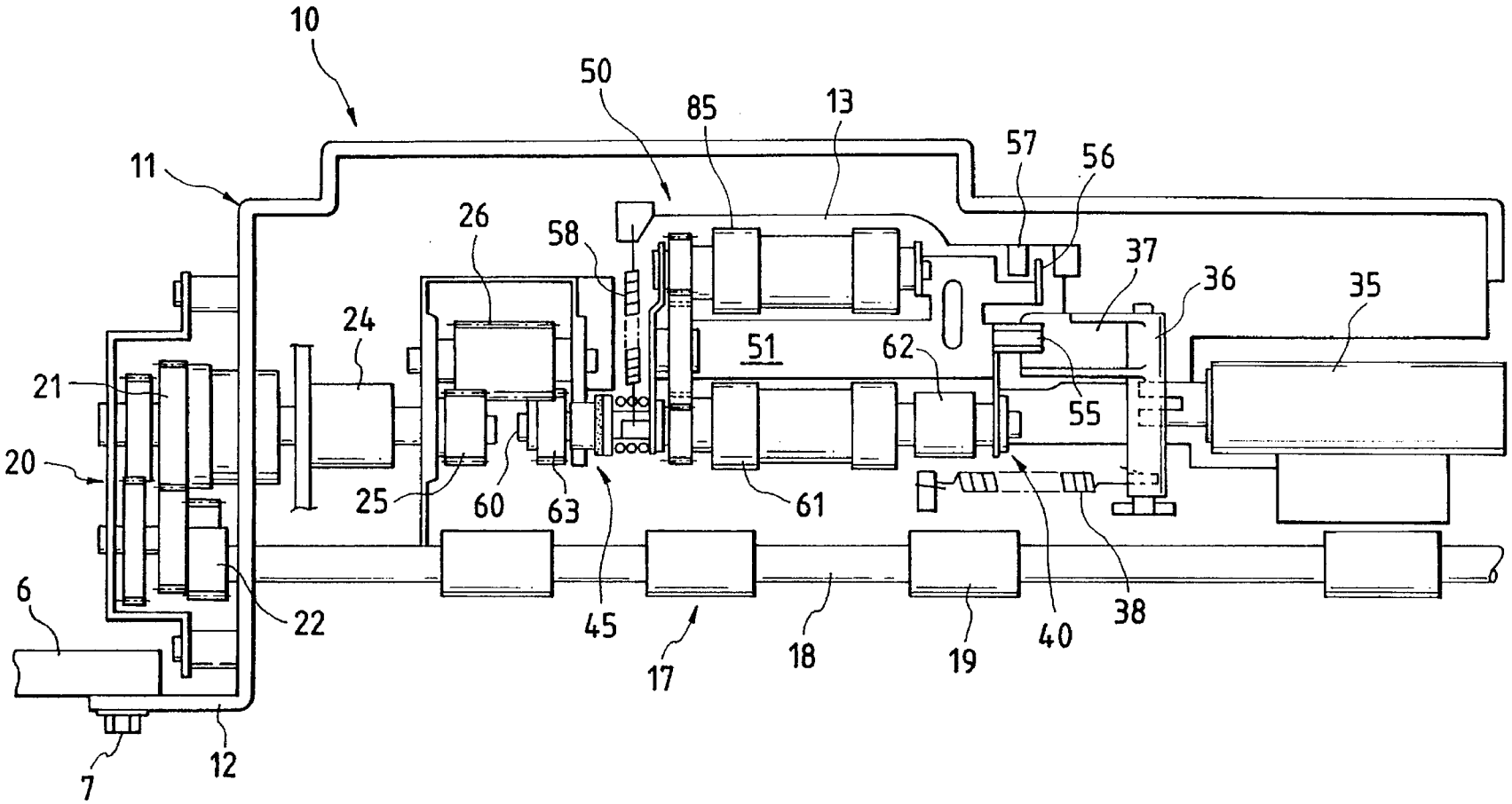
FIG. 1 is a schematic illustration showing an arrangement of the sheet feeding unit to which the sheet feeding roller unit of the present invention is attached.
Figure 2:
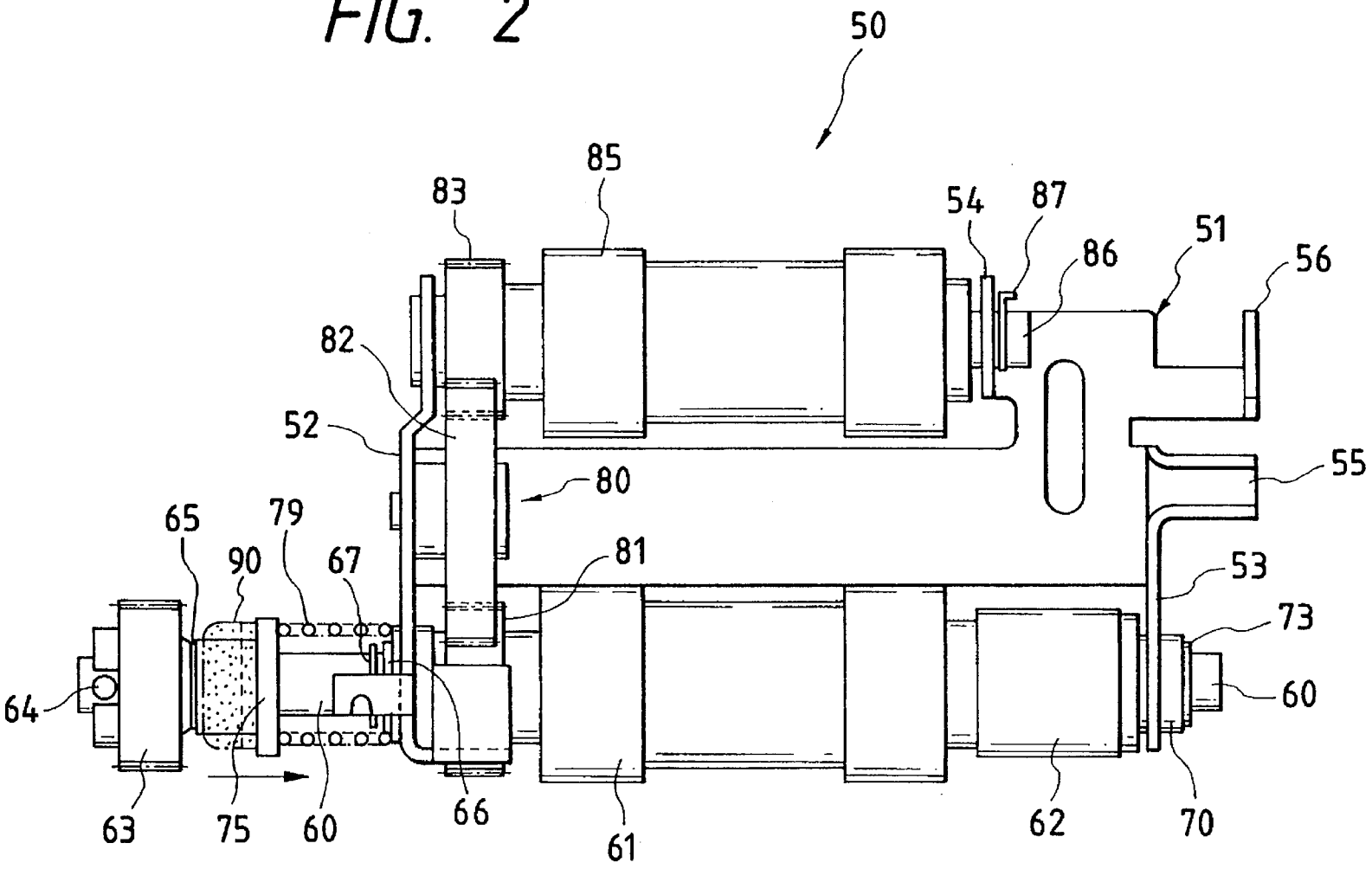
FIG. 2 is a schematic illustration showing an arrangement of the sheet feeding roller unit of the present invention.
Figure 14:
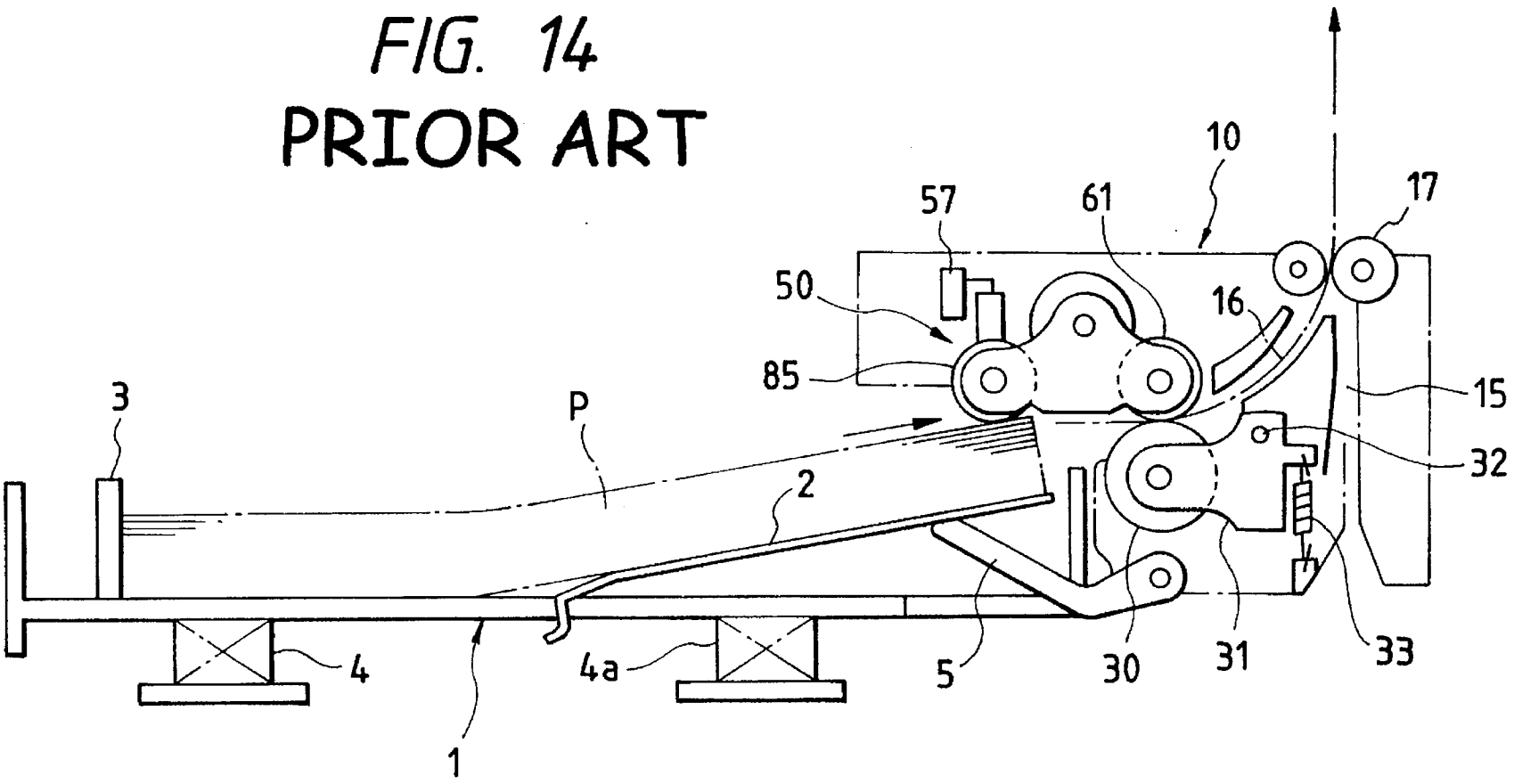
FIG. 14 PRIOR ART
FIG. 14 is a schematic illustration of an arrangement of the conventional sheet feeding section.
Figure 15:
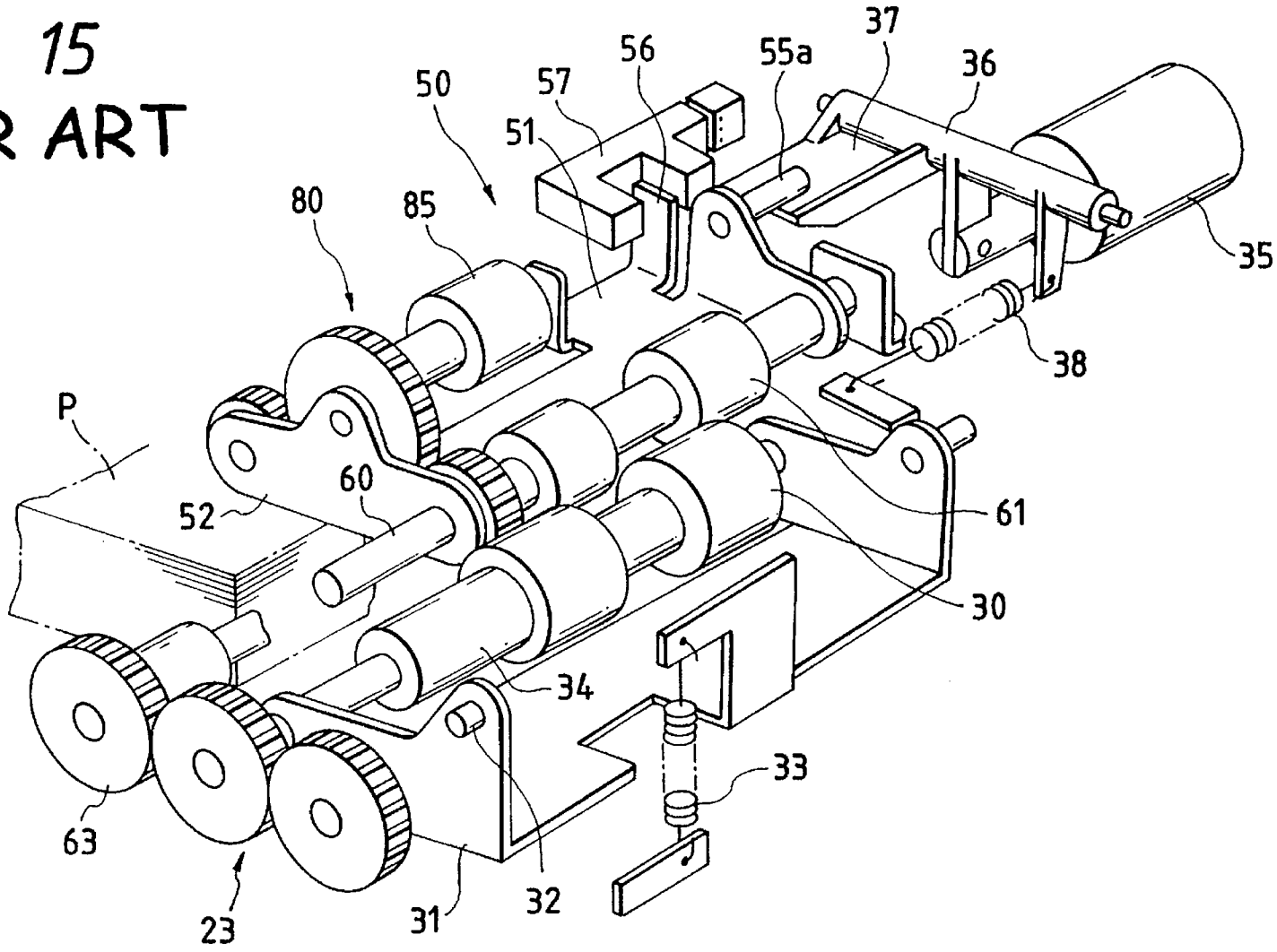
FIG. 15 PRIOR ART
FIG. 15 is a schematic illustration of an arrangement of the rollers disposed in the conventional sheet feeding unit.

Referring to the embodiment shown in the drawings, structure of the sheet feeder of the image forming apparatus of the present invention will be explained as follows. In the same manner as that of the apparatus shown in FIGS. 14 and 15, FIG. 1 is an arrangement view of the sheet feeder arranged in the sheet feeding section of the image forming apparatus. FIG. 1 is a view showing an arrangement of the sheet feeding unit 10 disposed in the sheet feeding section of the image forming apparatus, and FIG. 2 is a view showing an arrangement of the sheet feeding roller unit 50. A frame 11 of the sheet feeding unit 10 is fixed to a frame 6 of the main body of the image forming apparatus with a screw 7 through an attaching section 12 disposed at an end portion of the frame 11. There is provided a conveyance roller device 17 on the image forming apparatus main body side of the sheet feeding unit corresponding to the sheet feeding roller unit. The conveyance roller device 17 is driven by a drive source not shown in the drawing. Further, the conveyance roller device 17 drives the aforementioned sheet feeding roller through a gear 22 provided on the side of the sheet feeding unit and also through a gear 21 provided in the drive unit 20.

There is provided a clutch 24 between the gear 21 and an output gear 25. The output gear 25 drives a roller gear 63 disposed at the end of the sheet feeding roller shaft 60 through an idler gear 26. In the sheet feeding roller unit 50 of the present invention, as shown in FIG. 2, the first and the third bearings members 70, 75 arranged on both sides of the sheet feeding roller shaft 60 are respectively supported by the first and the second bearing engaging members 40, 45 arranged in the frame 11 of the sheet feeding unit 10. Due to the above structure, an oscillating shaft of the sheet feeding roller unit can be composed. A support bracket 51 of the sheet feeding roller unit is protruded onto the side, and an arm 55 is attached to the support bracket 51. The arm 55 is engaged with an arm 37 of the link 36 oscillated by the solenoid 35. In this way, a means for oscillating the pickup roller 85 is composed.

As described above, the sheet feeding roller unit detachably provided to the sheet feeding unit is composed as shown in FIG. 2. On one side of the support bracket 51, there is provided a left shaft support member 52. The transmission gear device 80, the sheet feeding roller shaft 60 of the sheet feeding roller 61 and pickup roller shaft 86 are respectively supported through the left shaft support member 52. On the other side of the support bracket 51, there are provided two right shaft supporting members 53, 54. The right shaft supporting member 53 supports the other side of the sheet feeding roller shaft 60, and the right shaft supporting member 54 supports the other side of the pickup roller shaft 86. Further, an arm 55 is protruded from the side of the support bracket at a position extended from the right shaft supporting member 53. In this way, a member to be mounted on the solenoid link is composed. In addition to the above structure, outside the right shaft supporting member 54 of the support bracket 51, there is provided an actuator 56 corresponding to the sheet height sensor.

The shaft 60 of the sheet feeding roller 61 is supported by the support bracket 51. With respect to the shaft 60 of the sheet feeding roller 61, the second bearing member 66 and the first bearing member 70 are respectively provided between the shaft supporting members 52, 53. In this way, the second bearing member 66 is held between the E-ring 67 and the left shaft supporting member 52. Further, there is stationarily provided a gear 63 between the pin 64 and the E-ring 65. At the other end of the shaft 60, the first bearing member 70 is engaged with the first bearing engaging member 40 provided in the sheet feeding unit, and the first bearing member 70 is fixed to the shaft through the E-ring 73. A sheet feeding roller 61 is mounted on the shaft 60 through the one-way clutch 62. Therefore, when the shaft 60 is rotated in the sheet feeding direction, the sheet feeding roller 61 is rotated, so that sheets of paper can be conveyed by the sheet feeding roller 61. In addition to the above structure, the gears 81, 83 are respectively mounted on the sheet feeding roller 60 and the pickup roller shaft 86. Further, there is provided a transmission gear unit 80 by which a drive force is transmitted through an idle gear 82. In this way, a means for driving the two rollers 61, 85, which are linked with each other, is composed.

Between the roller gear 63 and the second bearing member 66, there is provided a third bearing member 75 through which the shaft 60 can be rotated and slid. Between the third bearing member 75 and the second bearing member 66, there is provided a spring 79, so that the third bearing member 75 is pushed toward the gear 63 in the axial direction. Further, there is provided a lever member 90 corresponding to the third bearing member 75. When the lever member 90 is moved by a hand, the third bearing member 75 can be moved toward the second bearing member 66, resisting a force of the spring 79. In the present invention, when the shaft supporting member described above is used, as shown in FIG. 3, the sheet feeding roller shaft of the sheet feeding roller unit can be attached to the supporting means provided in the sheet feeding unit, and as shown in FIG. 4, the shaft 60 can be detached from the supporting means.

Figure 3:
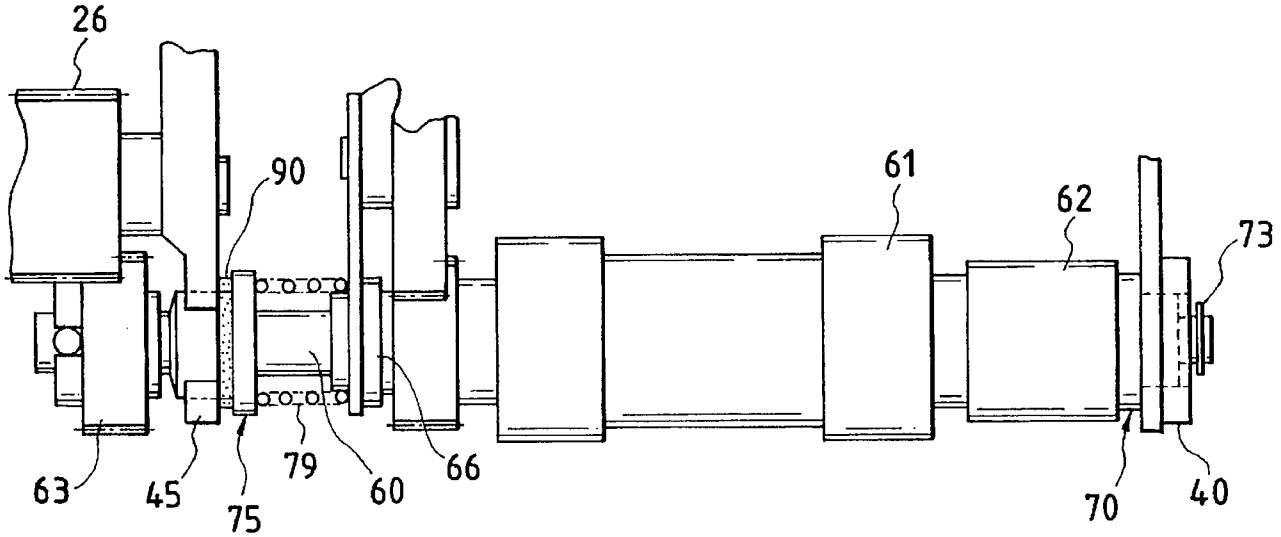
FIG. 3 is a schematic illustration showing a state in which the sheet feeding roller shaft is attached to the shaft support portion of the sheet feeding unit.
Figure 4:
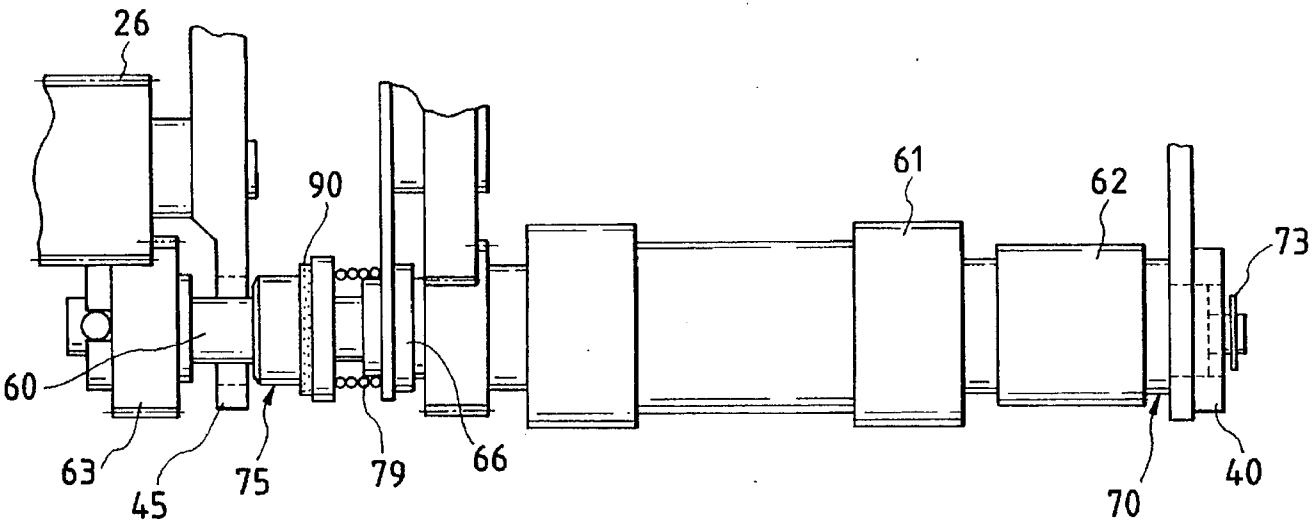
FIG. 4 is a schematic illustration showing a state in which the sheet feeding roller shaft is detached.

As shown in FIG. 3, the first bearing member 70 is engaged with the first bearing engaging member 40 and the third bearing member 75 is engaged with the second bearing engaging member 45, and further the sheet feeding roller shaft 60 is held by the sheet feeding unit. In the example shown in FIG. 3, the third bearing member 75 is pushed by the spring 79 so that the third bearing member 75 can be engaged with the second bearing engaging member 45, and the sheet feeding roller shaft is stationarily held by the first bearing member 70 engaged with the first bearing engaging member 40, and a roller driving force is transmitted when the roller gear 63 arranged at an end of the shaft 60 is meshed with the idler gear. In the case of disconnection of the shaft 60, as shown in FIG. 4, under the condition that the spring 79 is compressed by the lever member 90, the third bearing member 75 is moved toward the second bearing member 66, so that the third bearing member 75 can be pulled out from the second bearing engaging member 45. Then, the shaft 60 is disconnected from the second bearing engaging member 45. After that, when the unit is moved to the left in the drawing, the first bearing member 70 is disconnected from the first bearing engaging member 40. In this way, the sheet feeding roller unit can be detached from the sheet feeding unit.

Figure 5:
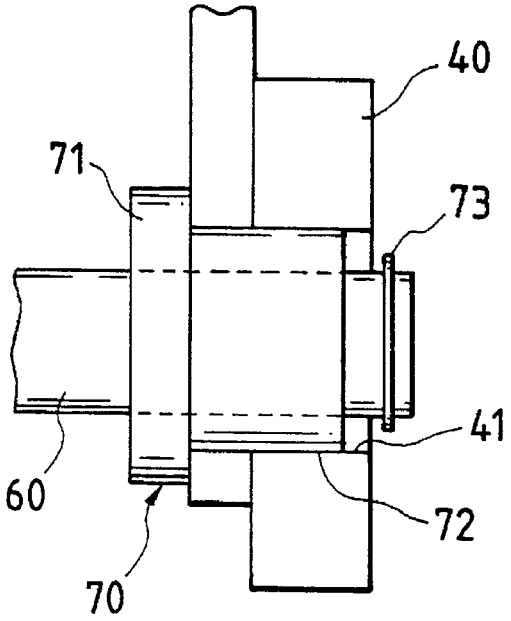
FIG. 5 is a schematic illustration showing a state in which the first bearing member is attached to the first bearing engaging member.
Figure 6:
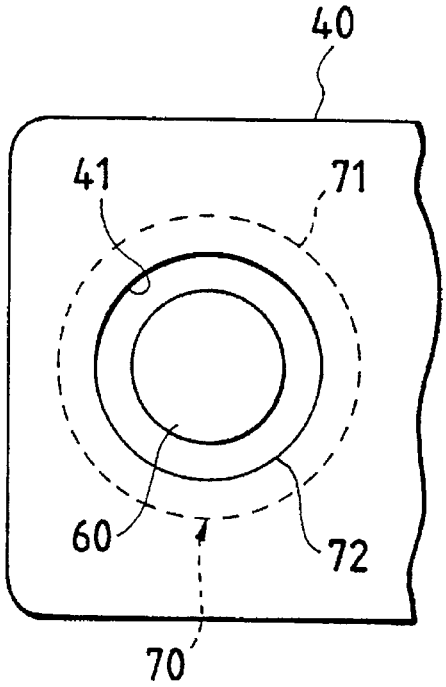
FIG. 6 is a front view of FIG. 5.

In order to detachably support the bearing members 70, 75 arranged at both ends of the shaft 60 by the bearing engaging members 40, 45 as described above, there are provided bearing members and bearing engaging members shown in FIGS. 5 to 8 according to the present invention. FIGS. 5 and 6 show an example of the arrangement of the first bearing member 70 and the first bearing engaging member 40. The first bearing member 70 arranged at an end of the shaft 60 includes a large diameter section 71 and a small diameter section 72. The small diameter section 72 is inserted into an insertion hole 41 of the first bearing engaging member 40, and a flange portion of the large diameter section 71 is fixed under the condition that the flange portion is pressed against the side of the first bearing engaging member 40. Since the first bearing member 70 composes a bearing which allows only the rotation of the shaft, the E-ring 73 is arranged at the end of the shaft 60 as shown in FIG. 2, so that the first bearing member can not be moved in the axial direction.

Figure 7:
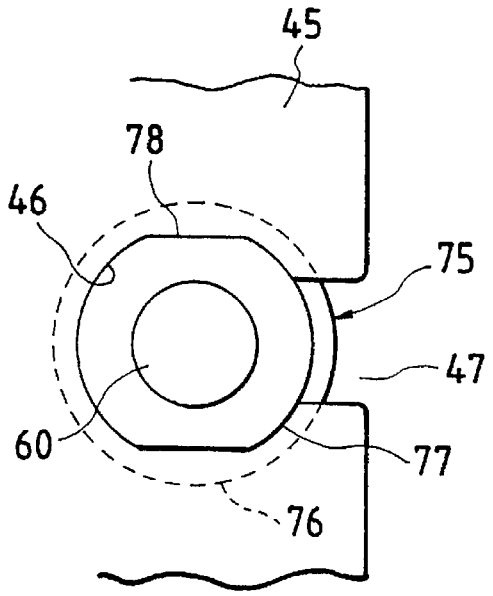
FIG. 7 is a front view showing a state in which the second bearing member is attached to the second bearing engaging member.
Figure 8:
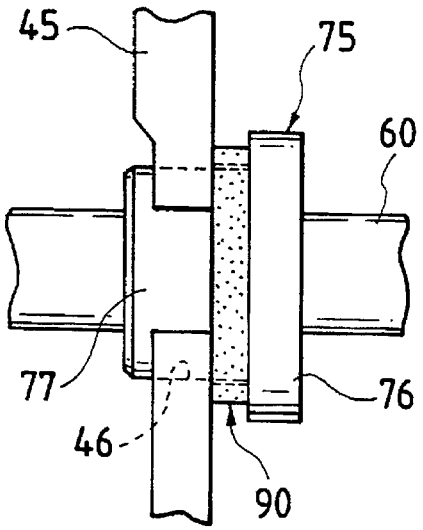
FIG. 8 is a side view of FIG. 7.

As shown in FIGS. 7 and 8, the third bearing member 75 attached at the other end of the shaft is arranged in such a manner that it can be slid on the shaft. The lever member 90 is arranged corresponding to the flange of the large diameter section 76. When the small diameter section 77 is inserted into the insertion hole 46 of the second bearing engaging member 45, the second bearing member can be fixed. In the second bearing engaging member 45 for supporting the second bearing member, there is formed an opening 47 with respect to the insertion hole 46. When the opening 47 is provided corresponding to the diameter of the shaft 60, the shaft 60 can be pulled out through the opening. When the third bearing member 75 is disconnected from the second bearing engaging member 45, the shaft 60 is pulled out from the opening of the second bearing engaging member under the condition shown in FIG. 4, and when the first bearing member 70 is disconnected from the first bearing engaging member 40, the sheet feeding roller can be disconnected. In this connection, since the third bearing member 75 is pushed by the spring from the back of the large diameter section, the shaft 60 of the sheet feeding roller unit can be supported with respect to the sheet feeding unit under the condition that the third bearing member 75 and the first bearing member 70 arranged at the end of the shaft are pushed by the spring.

Figure 9:
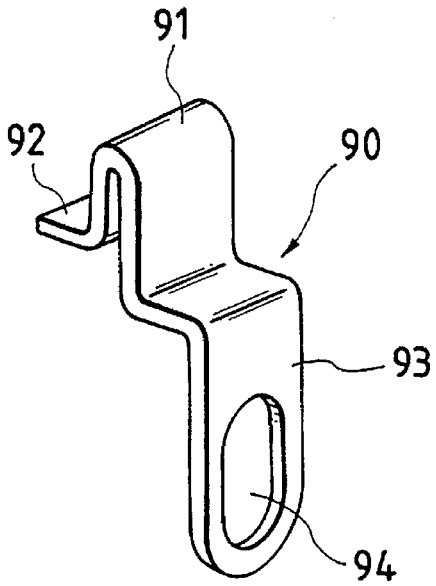
FIG. 9 is a perspective view showing an arrangement of the lever member of the present invention.
Figure 10:
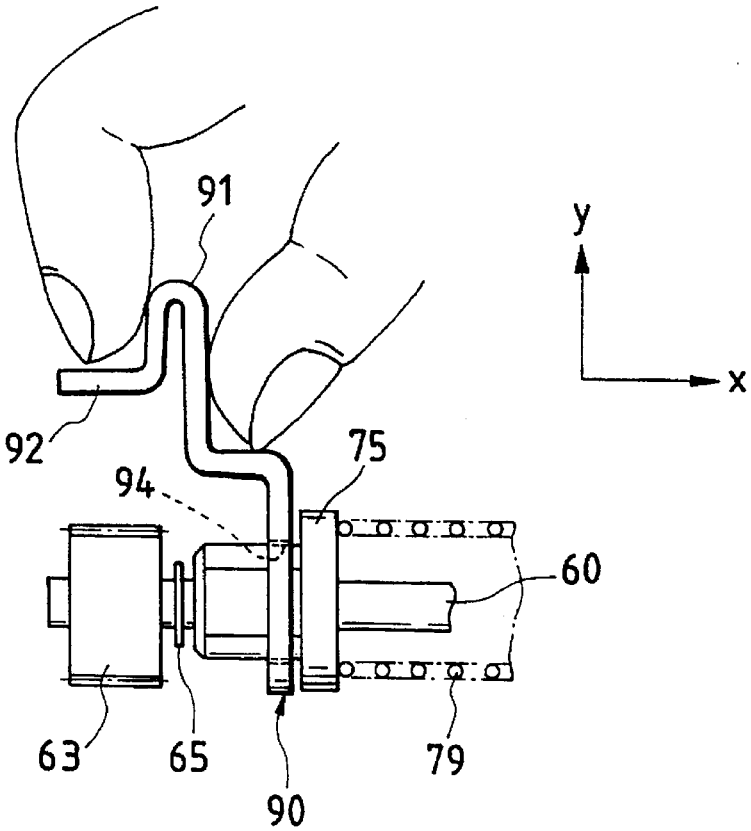
FIG. 10 is a schematic illustration showing a state in which the lever member is attached to the second bearing member.

In order to move the third bearing member 75 in the axial direction, the lever member 90 shown in FIG. 9 is used in the arrangement of the present invention. The lever member 90 is made by folding a metallic sheet. In the upper portion of the lever member 90, there is provided a pickup portion 91 which is protruded from the lever member, and there is provided a protective portion 92 at one end of the pickup portion 91, and further there is provided a hanging portion 93 on the other end of the pickup portion 91. In the hanging portion 93, there is formed a long hole 94 into which the small diameter portion of the second bearing member can be inserted. This structure is used when the third bearing member 75 is slid on the shaft 60 of the sheet feeding roller 61 as shown in FIG. 10. To be more specific, in the example shown in FIG. 10, when the pickup portion 91 is moved in the direction of "x" while the user holds the pickup portion 91 with his hand, the third bearing member 75 is moved to the right in the drawing while the spring 79 is being compressed, so that the small diameter section of the second bearing member is separated from the second bearing engaging member. After that, when the lever member 90 is moved in the direction of "y", that is, when the lever member 90 is lifted up while the pickup portion 91 is being held by the user, the shaft 60 can be pulled out from the opening of the second bearing engaging member.

Figure 11:
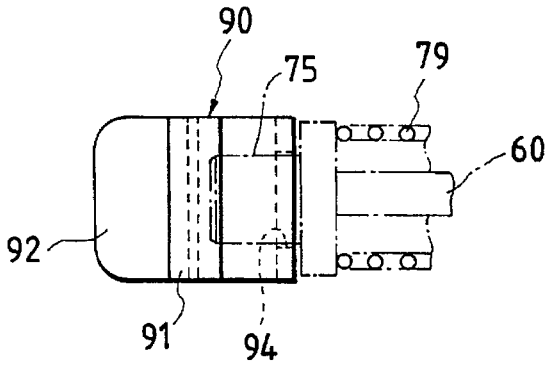
FIG. 11 is a plan view of the lever member.
Figure 12:
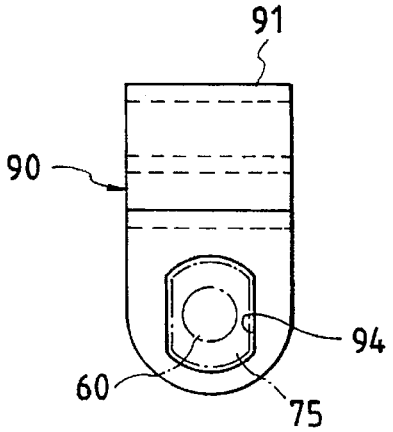
FIG. 12 is a front View of the lever member.

As shown in the plan view of FIG. 11 and the front view of FIG. 12, in the lever member 90, the protective portion 92 arranged on the side of the pickup portion 91 is disposed on the roller gear 63 arranged at the end of the shaft. Accordingly, even when the operator holds the lever member, his hand does not come into direct contact with the gear 63. Therefore, when the sheet feeding unit is replaced, safety of the operator can be surely maintained. Further, as shown in FIG. 12, the long hole 94 formed in the hanging portion of the lever member 90 is sufficiently larger than the small diameter portion of the third bearing member 75. Due to the foregoing, when the pickup portion 91 is moved by hand, it is possible to slightly incline the lever member. Accordingly, the lever member can be easily moved. In this connection, the shape of the lever member is not limited to the specific shape illustrated in the drawing. As long as the operator's hand can be protected from the gear and the pickup portion can be easily held by the operator's hand, any shape may be adopted to the lever member.

As described above, in the sheet feeding roller unit of the present invention, the first and the second bearing member arranged at both ends of the shaft of the sheet feeding roller are engaged with the first and the second bearing engaging member arranged in the sheet feeding unit. Therefore, the bearing members can be easily attached to and detached from the sheet feeding unit. When the sheet feeding roller unit is attached to the sheet feeding unit, the first bearing member is inserted into the first bearing engaging member, and the second bearing member is pushed to the second bearing engaging member by a spring force, so that the first bearing member is pushed toward the first bearing engaging member by a reaction force of the spring. Accordingly, the shaft of the sheet feeding roller can be fixed to the shaft support portion of the sheet feeding unit under the condition that the shaft is being pushed to the shaft support portion. When the sheet feeding roller unit is detached from the apparatus, only the second bearing member is disconnected from the second bearing engaging member using the lever member attached to the second bearing member. After that, the shaft is pulled out from the second bearing engaging member, and the first bearing member can be disconnected from the first bearing engaging member. In this way, the sheet feeding roller unit can be easily attached to and detached from the sheet feeding unit.

Figure 13:
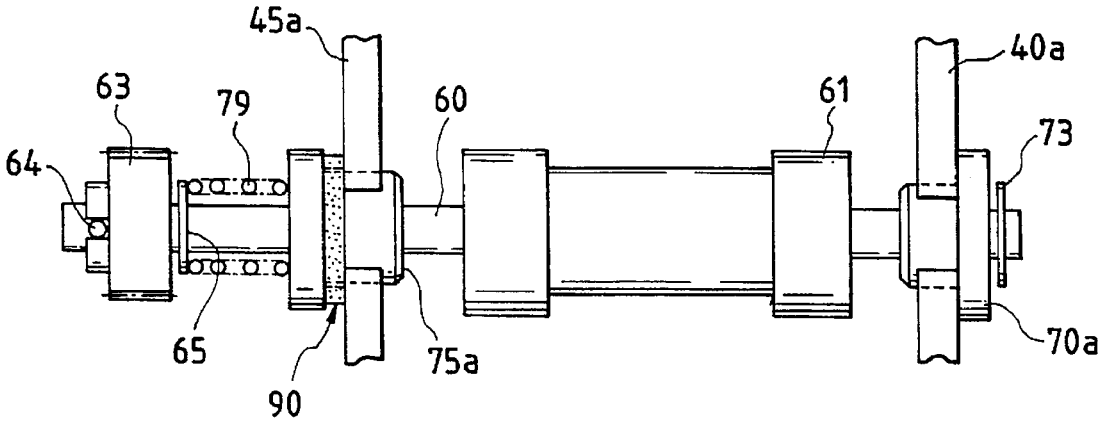
FIG. 13 is a schematic illustration of another embodiment of the present invention.

Other than the embodiments described above, it is possible to adopt a supporting structure of the sheet feeding roller unit shown in FIG. 13 in the present invention. In the embodiment shown in FIG. 13, only the structure of the sheet feeding roller is shown, however, the overall structure of the sheet feeding roller unit is the same as that shown in FIG. 2, and the sheet feeding roller unit is attached to the sheet feeding unit so as to conduct the sheet feeding operation in the same manner as that shown in FIG. 1. In this embodiment shown in FIG. 13, the first bearing receiving member **70*a* is arranged through the E-ring 73 at one end of the shaft 60 of the sheet feeding roller 61, and the roller gear 63 is arranged through the pin 64 and the E-ring 65 at the other end of the shaft 60. The third bearing member 75*a* is mounted on the shaft so that it can be slid in the axial direction by a force of the spring 79 which is held by the E-ring 65. In the drawing of this embodiment, the one-way clutch arranged between the shaft and the sheet feeding roller is omitted, and also the gear for transmitting a drive force to the pickup roller is omitted, however, they are provided in the same manner as shown in FIG. 2**.

The bearing engaging section for supporting the shaft 60 includes the first bearing engaging member **40*a* and the second bearing engaging member 45*a*. The above two bearing engaging members may be composed, for example, in the same manner as shown in FIGS. 7 and 8. To be more specific, each bearing engaging portion 40*a*, 45*a* includes an insertion hole into which the small diameter portion of the bearing is inserted, and an opening through which the shaft is pulled out. When each bearing is detached, the small diameter portion of the bearing is pulled out from the insertion hole, and the shaft is taken out through the opening of the bearing engaging portion. In this embodiment, the first and the third bearing members 70*a*, 75*a* are mounted on the shaft in such a manner that the small diameter portions of the two bearing members are opposed to each other. When the sheet feeding roller unit is attached to the sheet feeding unit, the first bearing member 70*a* is inserted toward the first bearing engaging member 40*a* from the right of the drawing and then fixed. In this case, first, the shaft 60 is inserted through the opening of the first bearing engaging member, and then the small diameter portion of the first bearing member 70*a* is engaged with the insertion hole of the first bearing engaging member. Next, the lever member 90*a* is moved toward the gear 63, and the shaft is inserted through the opening of the second bearing engaging member 45*a*. Then the lever member is released, and the small diameter portion of the third bearing member 75*a* is attached into the insertion hole of the second bearing engaging member 45*a*, so that the two bearings are attached in such a manner that they are pushed toward the bearing engaging portions by the force of the spring 79**.

As described above, when the sheet feeding roller unit, which is attached to the sheet feeding unit, is removed, first, the lever member 90 is operated so that the third bearing member 75*a* is moved in a direction in which the third bearing member 75*a* is pulled out from the second bearing engaging member 45*a*. Next, the sheet feeding roller shaft 60 is pulled out through the opening of the second bearing engaging member. After that, the shaft 60 is moved to the right in the drawing, so that the first bearing member 70*a* is disconnected from the first bearing engaging member 40*a*, and the shaft corresponding to the first bearing member is taken out through the opening of the first bearing engaging member. In this way, the sheet feeding roller unit can be disconnected from the sheet feeding unit. Due to the operation described above, the sheet feeding roller unit can be easily replaced. Accordingly, in the case of replacement of the rollers and also in the case of cleaning the rollers, it is possible to remove them easily without using special tools.

In this connection, the sheet feeding roller unit and the sheet feeding unit of the embodiment of the present invention are used when they are combined with the sheet feeder shown in FIGS. 14 and 15, and it is also possible to apply the attaching and detaching structure of the sheet feeding roller unit of the present invention to the sheet feeding section of the image forming apparatus of an arbitrary structure. In the embodiment of the present invention, the conventional structure may be applied to the sheet feeding rollers, that is, the structure of the pickup roller is not limited to the specific embodiment. Concerning the retard roller arranged being opposed to the sheet feeding roller, the structure is not limited to the specific embodiment, and a conventional retard roller used for a conventional sheet handling device may be applied to the structure of the embodiment of the present invention.

Since the apparatus of the present invention is composed as described above, when the sheet feeding unit is arranged in accordance with the sheet feeding tray disposed in the sheet feeding section of the image forming apparatus, the sheet feeding roller unit may be composed of a sheet feeding roller and a pickup roller capable of being oscillated around a shaft of the sheet feeding roller, wherein the sheet feeding roller and the pickup roller are combined with each other. A sheet feeding roller unit attaching means is composed in a portion where the sheet feeding roller shaft is connected with the drive unit for driving the sheet feeding unit. The first bearing member arranged at one end of the shaft is attached to and supported by the first bearing engaging member of the sheet feeding unit, and the second bearing member arranged at the other end of the shaft is detachably attached to the second bearing engaging member of the sheet feeding unit. Further, a lever member is arranged in the second bearing member which is detachably attached to the second bearing engaging member. When this lever member is moved by the operator's hand, the second bearing member can be attached to and detached from the second bearing engaging member. Accordingly, it is possible to replace the sheet feeding roller unit without using specific tools. Accordingly, in the sheet feeder of the present invention, it is possible to remove the bearing from the bearing engaging portion under the condition that the second bearing member is moved by the lever member, so that the roller can be easily replaced without the help of a skilled service man. Accordingly, only when the sheet feeding roller unit is distributed to the user, the apparatus can be easily maintained, so that the availability of the image forming apparatus can be enhanced.

What is claimed is:

1. A sheet feeder of an image forming apparatus comprising:

a bracket having a first and a second bearing means;

a first shaft means supported by said first and second bearing means;

a first roller means arranged between said first and second bearing means, attached to said first shaft means;

a third bearing means arranged at one end of said first shaft means, capable of being moved in the axial direction;

a pushing means for pushing said third bearing means in the axial direction of said shaft so that said third bearing means can be separate from said bracket;

a lever means for moving said third bearing means, resisting a pushing force of said pushing means, said lever means being capable of moving in the axial direction;

a first bearing engaging means for detachably engaging with said first bearing means; and a second bearing engaging means for detachably engaging with said third bearing means in the axial direction by the movement of said lever means and the push of said pushing means.

2. The sheet feeder of an image forming apparatus of claim 1, said sheet feeder, further comprising:

a first gear fixed to said first shaft means;

a second gear engaged with said first gear; and a driving means for driving said second gear.

3. The sheet feeder of an image forming apparatus of claim 1, further comprising:

a second shaft means, both ends of which are supported by said bracket; and a second roller means arranged in the middle portion of said second shaft means.

4. The sheet feeder of an image forming apparatus of claim 3, further comprising:

a group of gears for transmitting a torque from said first shaft means to said second shaft means.

5. A sheet feeder of an image forming apparatus comprising:

a roller means;

a shaft means of said roller means;

a supporting means for rotatably supporting said shaft means;

a bearing for supporting said shaft means, capable of moving with respect to said shaft means in the axial direction of said shaft means;

a pushing means for pushing said bearing with respect to said shaft means in the axial direction of said shaft means; and a first engaging means for engaging with said bearing by a pushing force given by said pushing means, said first engaging means being arranged on a casing of said apparatus wherein said pushing means applies no force to said shaft means in the axial direction when the pushing force is received by said supporting means and said bearing, wherein said supporting means includes a pair of bearings, said sheet feeder of said image forming apparatus further comprising a second engaging means for engaging with one of the pair of bearings arranged on the casing of said apparatus, wherein one of the pair of bearings is engaged with said second engaging means by the pushing force given by said pushing means.

6. The sheet feeder of an image forming apparatus of claim 5, wherein said supporting means restricts a movement of said first shaft means in the axial direction.

7. The sheet feeder of an image forming apparatus of claim 5, wherein said supporting means includes a pair of bearings, said sheet feeder of said image forming apparatus further comprising a second engaging means for engaging with one of the pair of bearings arranged on the casing of said apparatus, wherein one of the pair of bearings is engaged with said second engaging means by the pushing force given by said pushing means.

8. The sheet feeder of an image forming apparatus of claim 5, further comprising a lever for moving said bearing in a direction in which the movement of said bearing resists a pushing force of said pushing means.

9. A sheet feeder of an image forming apparatus comprising:

a roller means;

a shaft means of said roller means;

a supporting means for rotatably supporting said shaft means;

a pushing means for pushing said supporting means in the axial direction of said shaft means; and an engaging means for engaging with said supporting means by a pushing force given by said pushing means, said engaging means being arranged on a casing of said apparatus.

10. The sheet feeder of an image forming apparatus of claim 9, wherein said pushing means is arranged on a same shaft as said shaft means.

* * * * *